United States Patent [19]

Walton, III

[11] 4,161,416

[45] Jul. 17, 1979

[54] PRODUCTION OF ALUMINUM WIRE

[75] Inventor: William T. Walton, III, Decatur, Ga.

[73] Assignee: Alcan Aluminum Corporation, Cleveland, Ohio

[21] Appl. No.: 909,935

[22] Filed: May 26, 1978

[51] Int. Cl.[2] ..... C22F 1/04

[52] U.S. Cl. ..... 148/12.7 A

[58] Field of Search ..... 148/11.5 A, 12.7 A

[56] References Cited

U.S. PATENT DOCUMENTS

| | | | |
|---|---|---|---|
| 3,464,866 | 9/1969 | Pryor | 148/12.7 A |
| 3,843,418 | 10/1974 | Oida et al. | 148/12.7 A |
| 3,849,210 | 11/1974 | Kunsman | 148/12.7 A |
| 4,065,326 | 12/1977 | Nicoud | 148/12.7 A |

*Primary Examiner*—W. Stallard

*Attorney, Agent, or Firm*—Cooper, Dunham, Clark, Griffin & Moran

[57] ABSTRACT

Aluminum 6201 alloy wire is produced by drawing solution-heat-treated rod down to wire of desired diameter, for winding onto spools, under conditions that deliver the wire to the spool at an elevated temperature within a specific range predetermined for wire of such diameter, immediately placing each spool in a medium that passively retards the temperature decay rate of the wire to a value of about 50° to about 75° F. per hour, and maintaining the spool in the medium for a period of up to about four hours, to effect artificial aging without use of an oven or furnace, and thereby to achieve an artificially aged product, e.g. a product having a wire conductivity of at least about 52.5% IACS and mechanical properties of T-81 temper.

14 Claims, No Drawings

PRODUCTION OF ALUMINUM WIRE

BACKGROUND OF THE INVENTION

This invention relates to a process for artificially aging wire produced from rod of aluminum alloys that can be artificially aged, after working, to precipitate one or more constituents for development or enhancement of desired properties. It is particularly applicable to alloys containing magnesium and silicon (i.e. Al-Mg-Si alloys), wherein the precipitated constituent is magnesium silicide ($Mg_2Si$). In an important specific sense, the invention is directed to a process for producing artificially aged 6201 alloy electrical conductor wire.

For purposes of illustration, the invention will be particularly described with reference to wire made of the alloy having the Aluminum Association designation 6201, viz. an alloy of the following composition:

| | Range or Maximum (%) |
|---|---|
| Si | 0.50–0.9 |
| Fe | 0.50 |
| Cu | 0.10 |
| Mn | 0.03 |
| Mg | 0.6–0.9 |
| Cr | 0.03 |
| Zn | 0.10 |
| B | 0.06 |
| Others | 0.03 each/0.10 total |
| Al | balance |

In at least many commercial electrical conductor applications, it is required that the produced 6201 alloy wire be in the condition known as T81 temper and have the conductivity prescribed by ASTM specification B-398. That is to say, the wire is required to have an elongation (in 10 inches) of at least 3.0%, an average tensile strength of at least 48,000 p.s.i. (46,000 p.s.i. minimum) for wire of diameter less than 0.1327 inch, and 46,000 p.s.i. average (44,000 p.s.i. minimum) for wire of diameter of 0.1327 inch and above, and a conductivity of at least 52.5% of the International Annealed Copper Standard (IACS).

Such wire, in present-day commercial practice, is commonly produced by drawing down solution-heat-treated 6201 alloy rod in a so-called drawbench having a succession of dies through which the workpiece is drawn under tension (while oil is applied) to effect progressive reduction in diameter. For example, ⅜-inch diameter rod may be drawn down in this manner to produce wire of any desired diameter within a range of 0.060 inch (or below) to 0.188 inch (or above). At the exit end of the drawbench, the wire is wound on spools or bobbins.

For commercial production of 6201 alloy wire in T81 temper with ASTM B-398 conductivity, the wire must be subjected to artificial aging. Although such properties may be developed without artificial aging over extremely long time periods (months or even years) by "natural aging," i.e. very extended ambient-temperature storage of the wire, these time period are so long that natural aging is utterly useless in any practicable sense, and may be disregarded as of no consequence.

Heretofore, the artificial aging process has involved placing hot or cold bobbins of the wire in a heated oven for a prescribed time, in either a continuous aging operation (with conveyor transport of the bobbins through the oven) or a batch aging operation, and with oven temperatures ranging from 275° F. to 320° F. depending on cycle time and oven type. The term "oven aging" is used herein to refer to procedures wherein heat is supplied (in an oven or the like) to wire after drawing for the purpose of precipitating constituents to enhance desired mechanical properties and/or conductivity. It has been believed that these oven agings were necessary to artificially age the material by precipitation of magnesium silicide—as required to attain the desired mechanical properties and conductivity—without starting recrystallization in the aluminum matrix. Rapid precipitation begins from 305° F. to 320° F., depending on the heat history of the rod and drawn wire.

The described oven aging is disadvantageous in that it necessitates provision of aging furnaces or ovens, with attendant capital cost, and also requires supply of additional energy after drawing, as well as involving performance of a post-drawing step requiring inconveniently close control of process conditions. Thus, for the sake of convenience and economy, it would be desirable to produce an artificially aged 6201 wire product without oven aging, yet with reliable attainment of the requisite conductivity and mechanical properties. It would also be desirable to reduce scrap (due to tensile and conductivity rejections) as compared with conventional oven aging, where (for example) excessive temperatures and/or times may result in "overaging" with consequent loss of tensile strength.

Although discussed above with specific reference to 6201 alloy, the foregoing considerations are likewise applicable to other alloys of the 6000 series; and more generally, in the production of wire by drawing down rod of aluminum alloys such as Al-Mg-Si alloys, it has been customary to subject the wire to oven aging after drawing for precipitation of constituents and consequent enhancement of mechanical and/or conductivity properties. It would be desirable to achieve these properties without the capital cost, energy requirements, and inconvenience of the conventional oven aging step.

SUMMARY OF THE INVENTION

The present invention broadly embraces the discovery that, in the production of artificially aged wire products by working rod of aluminum alloy (such as Al-Mg-Si alloys) that are capable of being artificially aged, after working, for precipitation of constituents to enhance desired properties, such artificial aging can be effected without oven aging by utilizing heat developed in the working operations to raise the temperature of the wire into a predetermined elevated range at the end of the working step, and then passively retarding the rate of temperature decay of the wire from that range, i.e. retarding the rate of cooling by immediately thermally isolating the wire with a suitable retarding medium without any use or application of further heat. The invention, in this broad sense, embraces the further discovery that the particular elevated range, into which the wire temperature is to be raised by the working operation, is related to the final diameter or extent of reduction of the wire.

Thus, the present invention further contemplates a process for producing aluminum alloy wire products by working (e.g. drawing down) solution-heat-treated aluminum alloy rod to wire of selected diameter, wherein artificial aging to enhance mechanical and/or conductivity properties is effected, without use of an oven or any post-drawing application of heat to the wire, by performing the working step so that the finish working temperature of the wire (the temperature at the end of the working step) is in a particular elevated range, and passively (i.e. without supply of heat) retarding the cooling rate or rate of temperature decay of the wire from the finish working temperature until the desired mechanical properties and conductivity are realized. The requisite range for the finish working temperature (by which is meant, for working performed by drawing down on a drawbench, the temperature of the wire as delivered to the spool or bobbin at the exit end of the drawbench) is related to the finish diameter of the produced wire, in that, for a given initial rod diameter, larger wire diameters require a higher finish working temperature than do smaller wire diameters. The step of passively retarding the temperature decay rate is performed by placing the wire (e.g. wound on bobbins) in a suitable temperature-decay-retarding medium (viz. a thermally insulating medium) virtually immediately after completion of working, i.e. before it has undergone any substantial temperature drop from the finish working temperature, and maintaining the wire enclosed or surrounded by the retarding medium for the required time. The retarding medium may be any suitable substance, article or material that sufficiently reduces the rate of heat loss from the bobbins of wire, as compared with the cooling rate of bobbins exposed to air at ambient temperature.

Stated more specifically with reference to artificially aged 6201 alloy wire product, such wire having T81 mechanical properties and ASTM B-398 conductivity is produced in accordance with the invention by working (e.g. drawing down) solution-heat-treated 6201 alloy rod under conditions providing for the wire a finish working temperature in a range (upwardly of 320° F.) dependent on the finish wire diameter, and immediately placing the bobbins of wire in a retarding medium effective to provide a temperature decay rate of about 50° to about 75° F. per hour for about one to about four hours. Except for provision of the requisite finish working temperature, the working step may be an entirely conventional drawing-down operation, the requisite finish working temperature being achieved (for example) by employing an appropriately rapid drawing speed. The retarding step may be performed, for example, by confining the bobbins in an insulating medium, e.g. asbestos blankets. Although, as stated, the requisite finish working temperature range varies depending on the finish diameter of the wire, the conditions and duration of the retarding step may be essentially the same for all wire diameters.

In this way, desired artificially aged wire properties are achieved without the capital cost, energy consumption, and inconvenience of oven aging. It is found, also, that the present invention affords reduction in scrap losses due to tensile and conductivity rejections, because such losses have largely resulted from failure to maintain proper oven aging operating conditions.

Further features and advantages of the invention will be apparent from the detailed description hereinbelow set forth.

DETAILED DESCRIPTION

The invention will be described as embodied in procedure for producing wire by drawing down (e.g. in a conventional drawbench) solution-heat-treated ⅜ inch diameter 6201 alloy rod of the above-specified composition. The term "⅜-inch diameter rod," as used herein, refers to a standard rod size for wire production, having a dimensional tolerance of ±0.020 inch with single observations up to ±0.030 inch. An exemplary series of values of final wire diameter, with their cross-sectional areas (expressed as percent of the cross-sectional area of the initial ⅜-inch rod) are given below, assuming an average rod diameter of 0.385 inch with a cross-sectional area of 0.1164 in.$^2$:

| Final Wire Diameter (inches) | Cross-sectional Area (percent of cross-sectional area of ⅜-inch diameter rod) |
|---|---|
| 0.0661 | 2.95% |
| 0.0834 | 4.69 |
| 0.1052 | 7.47 |
| 0.1327 | 11.9 |
| 0.1489 | 15.0 |
| 0.1672 | 18.9 |
| 0.1878 | 23.8 |

The 6201 alloy rod, which is the starting material for the present process, may itself be produced in a conventional manner, preferably by rolling from cast wire bar, and is solution heat treated, preferably to provide the rod in T4 temper with a conductivity in the range of 49–54% IACS. Indeed very preferably, the solution heat treatment (including the quenching step) is performed in the final stages of rolling the bar into rod, i.e. while the reduction of the bar into rod is being completed. In the first step of the process of the invention, this previously solution-heat-treated rod is drawn down to wire of a desired or preselected final diameter in a drawbench. The drawbench, again, may be wholly conventional; i.e. it may be any type of drawbench currently used in drawing down aluminum rod into wire, and accordingly its construction, arrangement and operation, being entirely familiar to those skilled in the art, need not be described. It is contemplated that the drawing-down step will effect an area reduction of at least about 70%.

The working step of the process of the invention, in its presently described embodiment, comprises drawing down the rod into wire, which includes the advance of the workpiece under tension through successive dies of a drawbench to effect progressive reduction in diameter, with application of oil, and may be performed in a generally conventional manner except that, in accordance with the invention and as a particular feature thereof, the conditions of the drawing-down operation are so selected as to impart to the wire (as delivered to a bobbin at the exit end of the drawbench) a finish working temperature in a particular elevated range hereinafter further specified. In this regard, it will be appreciated that the working operations performed in drawing down rod into wire inherently impart heat to the workpiece, raising the temperature thereof. Variables that affect the extent of such inherent elevation of temperature of the workpiece during the drawing-down operation include the type of bench employed, the type and delivery rate of oil, the percent of slip in the bench, and the rate of drawing. Stated in general, the finish working temperature of the wire may be increased by increasing the drawing speed; hence the attainment of a finish working temperature in any specified range merely involves increasing the drawing speed from the normal or customary rate until the measured temperature of the wire exiting the drawbench reaches the desired value, and then maintaining that elevated speed (other conditions being held constant). If, however, in the particular equipment used the speed of drawing is constrained (for example, by limitations of horsepower of the drawbench), elevation in finish working temperature may alternatively be achieved by appropriate adjustment of other operating conditions. For example, reduction of oil supply or increase of slip will both produce increase in finish working temperature; in such case, it is at present preferred to so perform the drawing-down step as to impart much or most of the temperature elevation in the final stages of that step. That is to say, in a broad sense the drawing-down step of the invention in the described embodiment may be performed by controlling the speed and/or other conditions such as those just mentioned, to achieve the specified finish working temperature.

As stated, the finish working temperature is the temperature of the wire as delivered onto a bobbin and there wound at the exit end of the drawbench after the final wire diameter has been attained but prior to any substantial cooling of the wire after completion of the drawing-down operation. Further in accordance with the invention, it is found that this finish working temperature must be within a range of elevated temperatures determined by the extent of reduction in area of the workpiece during the drawing-down step, i.e. the total reduction of cross-sectional area from rod to wire. Thus, stated with reference to 6201 alloy wire produced from ⅜-inch rod, for attainment of the results of the invention, the requisite finish working temperature range is higher for wires of larger final diameter than for wires of smaller final diameter. Indeed, wires of relatively small final diameter are found to have adequate T81 mechanical properties even without performance of the subsequent retarding step of the present invention, though the retarding step (in conjunction with the drawing step) is necessary for attainment of adequate conductivity even in these small wires. With larger-diameter wires, the retarding step is needed to develop satisfactory mechanical properties as well as conductivity.

Specifically, for 6201 wire drawn down from ⅜-inch diameter, solution-heat-treated rod, a presently preferred series of ranges of approximate finish working temperatures for the indicated diameters of wires in accordance with the invention is as follows:

| Final Wire Diameter (in.) | Finish Working Temperature (°F.) |
|---|---|
| 0.060–0.120 | 320°–340° |
| 0.121–0.140 | 340°–360° |
| 0.141 and above | 360°–400° |

It will be appreciated that, in the working step of the invention, finish working temperatures in the above-specified ranges are achieved solely by the heating of the workpiece by the mechanical manipulation thereof incident to reduction of the rod to wire, i.e. without any external or supplemental supply of heat, being attained by mechanical deformation and/or friction. In the drawing-down operation of the presently described embodiment of the invention, this is accomplished by appropriate selection of drawing speed, slip and/or other conditions of drawing down; as will further be understood, the drawing speed necessary for any particular finish working temperature will vary from bench to bench and from oil system to oil system, but is readily determinable in any instance.

As a further particular feature of the invention, the bobbins of as-drawn wire exiting the drawbench, before having undergone any substantial drop in temperature from the finish working temperature established by the drawing-down step as described above, are immediately placed in a thermally isolating medium for passively retarding the rate of temperature decay of the wire and maintained in that medium for a period of typically about one to about four hours. The medium selected for passively retarding the rate of temperature decay is a substance, material or article that acts as a thermal barrier for substantially retarding heat losses (by radiation, conduction and/or convection) from the bobbins of wire, thereby to provide a rate of temperature drop of the bobbins of wire effective to cause artificial aging of the wire. Conveniently, this retarding step may be performed by immediately covering the bobbins of wire, as they exit the drawbench at the finish working temperature, with asbestos blankets (while supporting them on a substance such as wood having a relatively low coefficient of heat transfer) for retarding the temperature decay to a rate of about 50° to about 75° F. per hour and maintaining the bobbins thus covered with asbestos blankets for a period of about one to about four hours. It will be realized that, stated generally, the thermal isolation time and temperature decay rate of this passive retarding step are somewhat interdependent in that the time is shortened as the decay rate decreases.

The retarding step of the present process in the described embodiment effects precipitation of magnesium silicide and consequent development of the requisite ASTM B-398 conductivity (52.5% IACS) and also (in the case of the larger-diameter wires which do not already have T81 mechanical properties as drawn) the requisite elongation and tensile strength characteristic of T81 temper 6201 wire product. At the end of the retarding step, processing is complete, i.e. no further aging or other treatment is necessary to render the wire suitable for uses which require artifically aged 6201 wire.

In this way, then, artificial aging, for precipitation of magnesium silicide and consequent development of requisite mechanical properties and conductivity is achieved without the use of any oven or other post-drawing heating equipment and without necessitating any supply of heat energy after the drawing step, thereby affording economically advantageous savings in cost of wire production and capital expense.

It is found that the step of thus passively retarding the temperature decay rate of bobbins of wire from the finish working temperatures of the present invention in its described embodiment, as specified above, so as to provide a decay rate (from the finish working temperature) of about 50°–75° F. per hour for four hours will achieve T81 temper mechanical properties and ASTM B-398 conductivity for wires throughout the range of dimensions considered above. In other words, while the finish working temperature in the process of the invention is related to the extent of area reduction of the wire in the working step, the same temperature decay retarding conditions are equally effective for wires of all different dimensions throughout the above-specified range.

By way of further illustration of the invention, reference may be made to the following specific examples:

EXAMPLE I

Solution-heat-treated 6201 alloy rod, having a diameter of 0.3758 inch and a conductivity of 51.9% IACS at 22.80° C., was drawn down to wire having a diameter of 0.105 inch (actual range 0.1052–0.1064 inch) in a drawbench under conditions providing a finish working temperature of 340°–345° F. Samples subjected to temperature decay retarding under asbestos blankets for various periods of time were compared with other samples not subjected to any temperature-decay-retarding step. Results were as follows (Table I):

Table I

Process Conditions
A - no temperature-decay-retarding step
B - 2 hours under blankets
C - 3 hours under blankets
D - under blankets until cooled to room temperature

| Process Conditions | Sample No.** | Elongation % (10 in.) | Tensile Strength (1,000 p.s.i.) | Conductivity* (% IACS) |
|---|---|---|---|---|
| A | (1) | 3.3–4.5 | 45.8–45.9 | 51.6–51.7 |
| | (2) | 4.6–5.5 | 45.5–46.1 | 52.2–52.7 |
| | (3) | 4.0–5.3 | 44.8–45.0 | 52.6–52.8 |
| | (4) | 4.2–5.9 | 46.1–46.2 | 52.2–52.3 |
| | (5) | 4.2–4.5 | 45.6–45.9 | 51.7–52.0 |
| B | (1) | 7.0–8.3 | 48.1–48.2 | 54.3–54.8 |
| | (2) | 5.7–7.5 | 45.9–46.3 | 55.5–55.7 |
| | (3) | 6.3–7.5 | 47.3–48.2 | 54.6–55.0 |
| | (4) | 6.5–7.5 | 45.3–45.7 | 54.9–55.5 |
| | (5) | 5.2–6.5 | 47.2–47.4 | 54.3–54.5 |
| C | (1) | 7.2–7.8 | 47.7–48.3 | 54.0–54.3 |
| | (2) | 7.0–7.6 | 47.2–47.6 | 54.8–54.9 |
| | (3) | 6.6–7.0 | 45.7–46.0 | 55.3–55.5 |
| | (4) | 7.0–7.3 | 47.9–48.3 | 54.3–54.5 |
| | (5) | 6.8–7.6 | 47.2–47.3 | 54.4–54.8 |
| D*** | (3) | 6.8 | 46.0 | 54.7 |
| | (4) | 7.2 | 48.1 | 54.5 |

Notes
*Tests made at 21.30–22.35° C.
**Sample No. 4 bad finish working temperature of 345° F. All others were 340° F.
***No tests in samples (1), (2), and (5). Values in D are single data points. All other data in this table are maxima and minima of three data points.

These results show that, for the specified alloy, wire diameter and finish working temperatures involved, a retarding step of two hours or more achieved very marked improvement in conductivity, and also improvement in tensile strength and elongation, over samples cooled without retarding, but that continued retarding of the cooling rate until room temperature is reached affords no significant further benefit.

EXAMPLE II

Solution-heat-treated 0.3800-inch diameter 6201 alloy rod having a conductivity of 51.0% IACS at 21.35° C. and a tensile strength of 32,700 p.s.i. was drawn down to 0.105 inch diameter wire (actual range 0.1051–0.1054 inch) in a drawbench at a drawing rate of 3,300 ft./min., producing a finish working temperature of 350°–360° F. Some of the as-drawn bobbins of wire were subjected to temperature-decay-retarding by being covered with asbestos blankets for varying periods of time, while others were allowed to cool without retarding. Results were as follows (Table II, wherein all data are maxima and minima of three data points):

Table II

| Sample No.* | Elongation % (10 in.) | Tensile Strength (1,000 p.s.i.) | Conductivity** (% IACS) |
|---|---|---|---|
| No retarding step | | | |
| (1) | 5.5–5.5 | 48.3–48.9 | 51.2–54.7 |
| (2) | 5.0–6.3 | 47.3–47.6 | 51.7–51.8 |
| (3) | 5.0–5.3 | 47.2–47.4 | 51.8–52.3 |
| (4) | 4.3–5.0 | 47.8–48.1 | 51.1–51.2 |
| (5) | 5.4–7.0 | 47.0–47.3 | 52.1–52.3 |
| (6) | 4.0–4.7 | 45.9–46.0 | 52.2–52.3 |
| 2 hrs. under blanket | | | |
| (1) | 4.8–7.5 | 49.9–51.7 | 52.4–53.3 |
| (2) | 6.0–7.0 | 49.8–49.9 | 54.0–57.6 |
| (3) | 5.8–7.0 | 48.7–48.8 | 54.6–54.7 |
| 1 hr. under blanket | | | |
| (4) | 6.4–7.0 | 50.6–50.7 | 53.7–54.0 |
| (5) | 6.3–6.5 | 48.2–48.6 | 53.0–53.9 |
| (6) | 4.3–6.0 | 46.0–47.0 | 52.8–54.3 |

Notes
*Finish working temperatures were 355° F. for sample (3), 350° F. for sample (6), 360° F. for all others.
**Measured at 20.70°–22.30° C.

These tests showed that, compared to the wire of Example I having the same diameter, increase in finish working temperature above the specified range for that diameter did not significantly improve results; but a temperature-decay-retarding period as short as one hour was sufficient to achieve the requisite conductivity.

EXAMPLE III

Solution-heat-treated ⅜-inch diameter 6201 alloy rod was drawn down to 0.133-inch diameter wire (actual range 0.1327–0.1335 inch) in a drawbench at a drawing speed of 3,380 ft./min. Some bobbins of the wire were covered 4 hours with an asbestos blanket to retard temperature decay (bobbins designated "A" in the following table); others (designated "B") were not subjected to any retarding step. Results were as follows (Table III):

Table III

| Finish Working Temp. (°F.) | Elongation % (10 in.) | | Tensile Strength (1,000 p.s.i.) | | Conductivity* (% IACS) | |
|---|---|---|---|---|---|---|
| | A | B | A | B | A | B |
| 355° | 6.2 | 5.0 | 47.3 | 45.1 | 52.5 | 51.4 |
| 330° | 6.8 | 5.0 | 47.2 | 44.9 | 52.4 | 51.4 |
| 355° | 7.0 | 5.2 | 47.7 | 44.0 | 53.4 | 51.5 |
| 380° | 6.0 | 6.0 | 49.8 | 45.2 | 53.9 | 50.9 |
| 380° | 8.0 | 6.0 | 50.1 | 45.4 | 54.4 | 52.2 |
| 370° | 6.5 | 6.2 | 46.9 | 45.3 | 54.2 | 52.7 |

Notes
*Measured at 22.65°–22.80° C.

Again, the retarding step significantly enhanced conductivity and tensile strength.

EXAMPLE IV

Solution-heat-treated ⅜-inch-diameter 6201 alloy rod having a conductivity of 51.9% IACS was drawn down in a drawbench to 0.149-inch diameterrod (actual range 0.1488–0.1496 inch), with finish working temperatures of 365° (sample 1) and 380° (samples 2–5). In sample 1, the drawing rate was about 3500 ft./min. Some bobbins were subjected to temperature-decay-retarding under asbestos blankets for periods of 2 hours (condition B), 3 hours (condition C), and 4 hours (condition D), while others (condition A) were not subjected to any retarding. Comparative results were as follows (Table IV):

Table IV

| Process Conditions | Sample No. | Elongation % (10 in.) | Tensile Strength (1,000 p.s.i.) | Conductivity* (% IACS) |
|---|---|---|---|---|
| A | (1) | 5.5–6.3 | 44.5–44.8 | 51.9–52.1 |

Table IV-continued

| Process Conditions | Sample No. | Elongation % (10 in.) | Tensile Strength (1,000 p.s.i.) | Conductivity* (% IACS) |
|---|---|---|---|---|
| | (2) | 6.5–6.8 | 43.7–43.7 | 51.9–52.4 |
| | (3) | 5.5–5.9 | 42.4–42.7 | 52.3–52.7 |
| | (4) | 6.5 7.5 | 45.3–45.7 | 51.3–51.9 |
| | (5) | 7.0–7.5 | 44.9–45.2 | 52.3–53.1 |
| B | (1) | 3.8–7.3 | 44.6–47.8 | 53.6–53.9 |
| | (2) | 6.0–6.3 | 46.5–51.1 | 53.7–54.2 |
| | (3) | 57.–6.0*** | 44.8–45.1 | 55.7–56.6 |
| | (4) | 4.5–7.3 | 47.3–48.7 | 54.5–55.4 |
| | (5) | 4.7–6.0*** | 46.1–47.8 | 53.8–55.3 |
| C | (1) | 7.4** | 47.8–48.1 | 54.1–54.2 |
| | (2) | 6.4–7.5 | 44.6–45.5 | 56.0–56.8 |
| | (3) | 5.0–7.0 | 43.4–43.9 | 56.0–57.3 |
| | (4) | 5.0–6.8 | 45.7–46.7 | 56.1–56.6 |
| | (5) | 5.2–5.8*** | 46.9–47.0 | 55.5–55.8 |
| D | (1) | 6.2–7.2 | 44.8–47.3 | 55.3–55.8 |
| | (2) | 6.8–7.7*** | 44.5–44.8 | 55.7–56.7 |
| | (3) | 5.8–7.6 | 43.1–43.7 | 56.9–57.3 |
| | (4) | 7.3–7.3*** | 46.3–47.0 | 56.2–56.6 |
| | (5) | 6.7–7.0 | 46.2–46.3 | 55.9–56.4 |

Notes
*Measured at 20.40°–22.90° C.
**Only one data point taken
***Only two data points taken (All other values indicate maximum and minimum of three data points.)

EXAMPLE V

Solution-heat-treated ⅜-inch-diameter 6201 alloy rod was drawn down in a drawbench to 0.165-inch diameter wire (actual range 0.1640–0.1659) with a finish working temperature of about 380°. After temperature-decay-retarding isolation for 4 hours under asbestos blankets, results were as follows (maximum and minimum of 230 data points):

| | |
|---|---|
| Elongation % (10 in.) | 5.2–9.1 |
| Tensile strength (1,000 p.s.i.) | 44.3–53.3* |
| Conductivity (% IACS) | 52.6–55.8 |

*All but 2 data points 46.0 or above

It is to be understood that the invention is not limited to the features and embodiments hereinabove specifically set forth, but may be carried out in other ways without departure from its spirit.

I claim:

1. In a process for producing wire from rod of an aluminum alloy having a composition for precipitating at least one constituent upon artificial aging to enhance desired alloy properties, including the step of working the rod into wire with a predetermined extent of area reduction, the improvement which comprises:
   (a) performing said working step under conditions for imparting to the wire a finish working temperature in a preselected elevated range, and
   (b) passively retarding the rate of temperature decay of the wire from said finish working temperature for a period of time sufficient to effect substantial precipitation of said one constituent,
   (c) said elevated range being such that said retarding step, performed on wire that has been worked with said predetermined extent of area reduction, effects artificial aging of the wire.

2. A process according to claim 1, wherein said desired alloy properties include electrical conductivity.

3. A process according to claim 1, wherein said alloy contains magnesium and silicon and wherein said one constituent is magnesium silicide.

4. A process according to claim 3, wherein said rod is solution-heat-treated before the working step.

5. A process according to claim 4, wherein said alloy is 6201 alloy.

6. A process according to claim 1, wherein said retarding step comprises placing the wire, immediately after completion of the working step, in a medium that substantially retards heat transfer from the wire, and maintaining the wire in said medium for said period of time.

7. A process according to claim 1, wherein said working step comprises drawing down the rod into wire.

8. A process according to claim 7, wherein said wire is wound on a bobbin immediately upon completion of drawing down, and wherein said retarding step comprises covering the bobbin with a blanket.

9. In a process of producing a wire product from solution-heat-treated rod of 6201 aluminum alloy, including the step of drawing the rod down into wire with a predetermined extent of cross-sectional area reduction, the improvement which comprises
   (a) performing said drawing-down step under conditions for imparting to the wire a finish working temperature in a preselected elevated range and
   (b) passively retarding the rate of temperature decay of the wire from said finish working temperature for a period of time sufficient to effect substantial precipitation of magnesium silicide in said wire,
   (c) said elevated range being such that said retarding step, performed on wire that has been drawn down with said predetermined extent of area reduction, provides artificially aged wire.

10. A process according to claim 9, wherein said artificially aged wire is in T81 temper and has a conductivity of at least about 52.5% IACS.

11. A process according to claim 9, wherein said wire is wound on a bobbin immediately upon completion of the drawing-down step, and wherein the retarding step comprises immediately placing the bobbin of wire in a medium that substantially retards heat transfer from the wire, and maintaining the wire in said medium for said period.

12. A process according to claim 11, wherein said medium is an asbestos blanket and is placed in covering relation to said bobbin for said retarding step.

13. In a process for producing an artificially aged wire product from rod of an artificially ageable aluminum alloy, wherein the rod is reduced to wire by working and the wire is artificially aged, the improvement which comprises
   (a) utilizing heat inherently developed in the working step to raise the temperature of the wire, at the end of the working step, into a predetermined elevated range and
   (b) passively retarding the rate of temperature decay of the wire from said range for effecting artificial aging of the wire.

14. A process according to claim 13, wherein the passive retarding step comprises placing the wire in a thermally isolating medium.

* * * * *